US008928242B2

(12) United States Patent
Goyal et al.

(10) Patent No.: US 8,928,242 B2
(45) Date of Patent: Jan. 6, 2015

(54) DIMMER FOR LIGHT EMITTING DIODES AND FLUORESCENT BULBS

(75) Inventors: Rahul Goyal, Tyrone, GA (US); Oscar Neundorfer, Senoia, GA (US); James Fair, Fayetteville, GA (US)

(73) Assignee: Cooper Technologies Company, Houston, TX (US)

( * ) Notice: Subject to any disclaimer, the term of this patent is extended or adjusted under 35 U.S.C. 154(b) by 272 days.

(21) Appl. No.: 13/083,050

(22) Filed: Apr. 8, 2011

(65) Prior Publication Data

US 2012/0256558 A1 Oct. 11, 2012

(51) Int. Cl.
*G05F 1/00* (2006.01)
*H05B 33/08* (2006.01)

(52) U.S. Cl.
CPC ..... *H05B 33/0815* (2013.01)
USPC ..... 315/291

(58) Field of Classification Search
CPC ..... H05B 33/0815; H05B 33/0818; H05B 37/02; Y02B 20/346; Y02B 20/347
USPC ..... 315/294
See application file for complete search history.

(56) References Cited

U.S. PATENT DOCUMENTS 4,752,719 A * 6/1988 McEwan ..... 315/200 R

* cited by examiner

*Primary Examiner* — Thienvu Tran
(74) *Attorney, Agent, or Firm* — King & Spalding

(57) ABSTRACT

A dimmer system for a luminaire is provided. The dimmer system has a dimmer that receives a first current and supplies a reduced-magnitude current. The dimmer system also has a boosting system that receives the reduced-magnitude current and supplies a boosted current to a light source or lamp if the reduced-magnitude current is being received in conjunction with the initial turn-on of the dimmer. The boosted current can be provided for a predetermined period of time. The boosted current can also be provided as pulses of boosted current interspersed with pulses of the reduced-magnitude current. The boosted current can have the magnitude of the first current or range from 70% to 100% of the first current.

15 Claims, 3 Drawing Sheets

DIMMER FOR LIGHT EMITTING DIODES AND FLUORESCENT BULBS

TECHNICAL FIELD

The disclosure relates generally to apparatus and methods for providing dimming functionality for luminaires. More specifically, the disclosure relates to methods and apparatus for providing dimming functionality for light sources without an undesirable delay between activation of the dimmer and illumination of the light source.

BACKGROUND

Dimmers for incandescent light bulbs are in wide use in the lighting industry, and are installed in millions of buildings worldwide. Dimmers are used to cause bulbs to provide less light than they would if provided with the full power from the main circuit. In most electrical systems, main power is provided with alternating current (AC). Dimmers operate by "chopping up" the AC signal—specifically, for a given cycle of the AC wave, preventing some proportion of the wave from being transmitted to the luminaire. As more dimming is desired, a larger proportion of the wave is blocked. By blocking a portion of the wave, the total root-mean-square ("RMS") voltage provided to the light source falls.

This system of dimming is very effective for incandescent bulbs, for which the total illumination has a direct relationship with the RMS voltage provided to the bulb. This dimming technology does not work as well, however, for some other types of light sources, including, but not limited to, luminaires with light emitting diode ("LED") light sources, organic light emitting diode ("OLED") light sources, or compact fluorescent bulbs. This is because OLED light sources, LED light sources, and compact fluorescent bulbs have an electronic ballast (for compact fluorescent bulbs) or driver (for OLED and LED light sources) that converts the main current into current that is appropriate for the given light source. The ballast/driver requires electrical power to perform its conversion. When the power provided to the ballast/driver is reduced by the dimmer, the ballast/driver may not function properly. This may manifest itself in several ways. For example, the light source may fail to illuminate entirely, or there may be a noticeable delay before the light source illuminates. In lighting applications, neither result is desirable.

SUMMARY

The present invention provides a dimmer system for a luminaire. The dimmer system includes a dimmer that receives a first current and provides a reduced-magnitude current. The dimmer system also includes a boosting system that receives the reduced-magnitude current. If the boosting system determines that the reduced-magnitude current is being received as part of the initial turn-on of the dimmer, the boosting system provides a boosted current to a light source. The light source can be a light emitting diode.

The magnitude of the boosted current can be the magnitude of the first current, or some proportion thereof, such as 70-100%. The boosting system provides the boosted current for a predetermined period of time, which can be about 0.5 seconds. The boosted current can also be pulsed, wherein pulses of boosted current are interspersed with pulses of the reduced-magnitude current.

The present invention also provides a method for dimming a light source. A first current is received from a power source. The magnitude of the first current is reduced. It is then determined whether the reduced-magnitude current is being received as part of a turn-on of a dimmer. If the reduced-magnitude current is being received as part of a turn-on of a dimmer, a boosted current is provided to a light source. The light source can be a light emitting diode.

The boosted current can be provided for a predetermined period, such as 0.5 seconds. The boosted current can be pulsed such that pulses of the boosted current are interspersed with pulses of the reduced-magnitude current.

The present invention also provides a method for providing light. A first current is received from a power source. The magnitude of the first current is reduced based on the dimmer setting and the reduced-magnitude current is provided to a boosting system. If it is determined that the reduced-magnitude current is being received in connection with the turn-on of the dimmer, a boosted current is provided to a light source that is sufficient to illuminate the light source.

Providing sufficient boosted current can involve providing the boosted current for a predetermined period of time, such as 0.5 seconds. Providing sufficient boosted current can also involve monitoring the current drawn by a light source, and determining whether the current exhibits a signature that indicates that the light sources being illuminated. The light source can be a light emitting diode, and can include a driver.

These and other aspects, features, and embodiments of the invention will become apparent to a person of ordinary skill in the art upon consideration of the following detailed description of exemplary embodiments.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
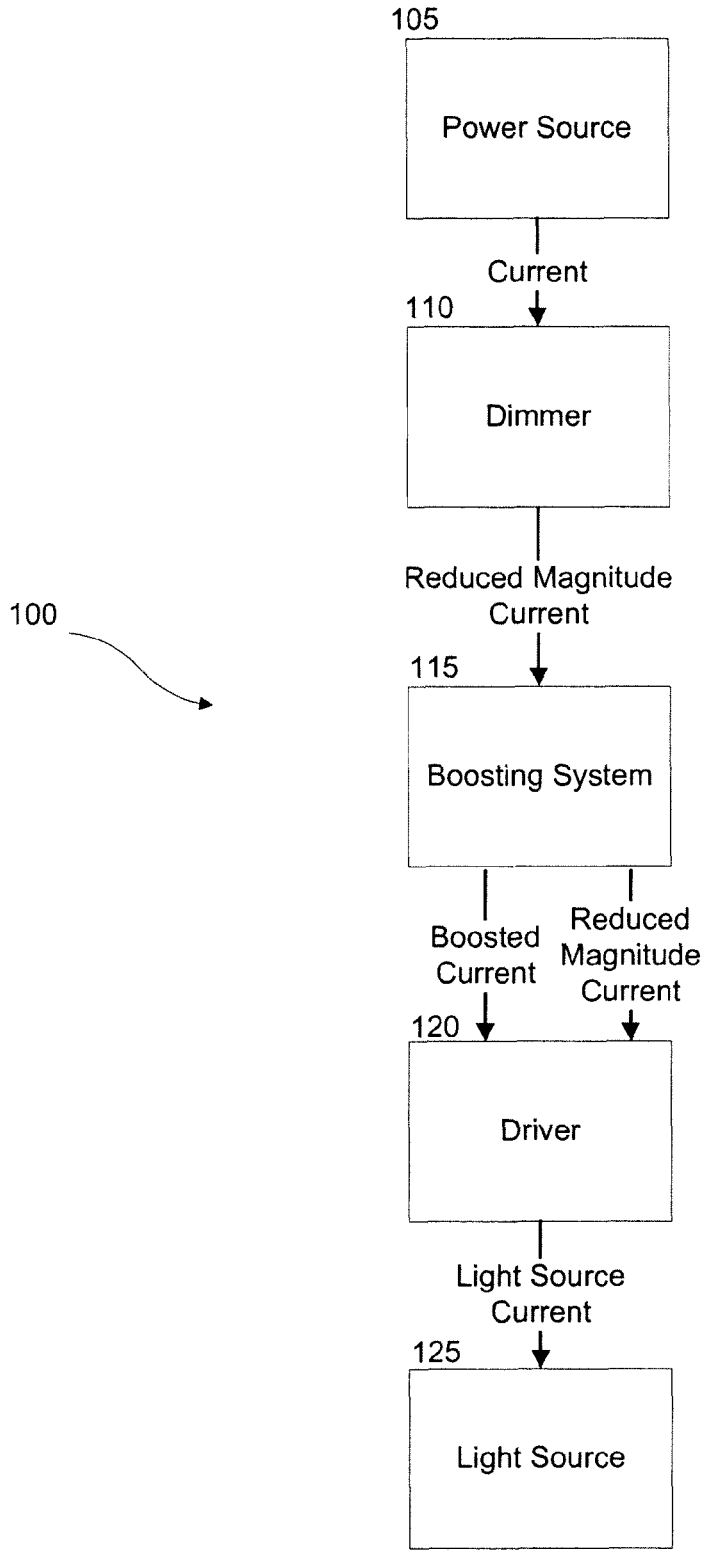
FIG. 1 is a block diagram illustrating an exemplary system for dimming a light source according to one exemplary embodiment.

The drawings illustrate only exemplary embodiments of the invention and are therefore not to be considered limiting of its scope, as the invention may admit to other equally effective embodiments. As one of skill in the art would understand, the electrical characteristics and response of certain components can often be replicated by the use of other components and/or combinations of components. In the drawings, reference numerals designate like or corresponding, but not necessarily identical, elements.

DETAILED DESCRIPTION OF EXEMPLARY EMBODIMENTS

The present invention is directed to electrical lighting devices. In particular, certain exemplary embodiments of this invention are directed to providing a dimmer that illuminates a light source, such as a compact fluorescent bulb, LED, or OLED. The present invention illuminates the light source without an undesirable delay between activation of the dimmer and illumination of the light source.

The invention may be better understood by reading the following description of non-limiting, exemplary embodiments with reference to the attached drawings, wherein like or corresponding, but not necessarily identical, parts of each of the figures are identified by the same reference characters, and which are briefly described as follows. FIG. 1 is a block diagram describing an exemplary system 100 for dimming a light source 125. The system 100 includes a power source 105 that is electrically coupled to a dimmer 110. The power source 105 delivers power to the system 100. In one exemplary embodiment, the power source 105 is an alternating current mains power source operating at, for example, 120/240 volts at 60 Hz in the United States, 230 volts at 50 Hz in the United Kingdom, or another combination of magnitude and frequency. Generally, the magnitude and frequency of the mains power depends on the standard adopted by the region in which the system 100 is installed.

The dimmer 110 is electrically coupled to the power source 105 and a booster system 115. In one exemplary embodiment, current from the power source 105 is electrically delivered to the dimmer 110. In certain exemplary embodiments, the dimmer 110 is a dimmer switch. The exemplary dimmer switch 110 is capable of being configured in many different forms including, but not limited to, a rotary dimmer, a slide dimmer, a touch-pad dimmer, and the like. The exemplary dimmer 110 reduces the magnitude of the current received from the power source 105. Specifically, the dimmer 110 outputs a reduced-magnitude current as compared to the current received from the power source 105 depending on the setting of the dimmer 110. In one exemplary embodiment, the dimmer 110 outputs a reduced-magnitude current by reducing the RMS voltage of the current received from the power source 105, which occurs by cutting off a portion of the input current waveform. The cut-off portion of the input current waveform grows or shrinks in proportion to the dimmer 110 setting. In this embodiment, the dimmer 110 employs a microcontroller, ASIC, or other component that is configured to cut off a portion of the input waveform. In an alternative embodiment, the dimmer 110 uses discrete components, such as a triac to cut off a portion of the input waveform. As one of ordinary skill in the art would understand, however, the invention is not limited to these methods of reducing the magnitude of the input current, as there are several well known methods of reducing the magnitude of a current. Further, as one of ordinary skill in the art would understand, in certain cases, the dimmer 110 setting would be such that the magnitude of the input current would not be reduced, such as when the dimmer 110 is set to deliver full power to the light source 125.

The boosting system 115 is electrically coupled to the dimmer 110 and a driver 120. In the exemplary embodiment, the reduced-magnitude current is electrically transmitted from the dimmer 110 to the boosting system 115. The exemplary boosting system 115 electrically supplies either a boosted current or the reduced-magnitude current to the driver 120, as described below. The driver 120 then electrically supplies a current to the light source 125.

In one exemplary embodiment, the boosting system 115 modifies the magnitude of the reduced-magnitude current and outputs a boosted current that is appropriate to cause a given light source 125 to illuminate without an undesirable delay after activation of the dimmer 110. In one exemplary embodiment, the boosting system 115 senses that the dimmer 110 has been activated and outputs the boosted current, which in one exemplary embodiment, is a proportion of the current received from the power source 105. By way of example, the boosting system 115 can output a boosted current that is 100% of the full current, or some smaller proportion thereof, such as 90%, 80%, or 70%. The precise proportion of the current from the power source 105 that the boosting system 115 outputs can vary based on specific details associated with the system, such as the type of light source 125 and driver 120 used, and the magnitude and frequency of the current received from the power source 105. A person of ordinary skill in the art, upon reading this disclosure, would be capable of selecting an appropriate boosted current.

In one exemplary embodiment, the boosting system 115 electrically supplies to the driver 120 the boosted current for a predetermined period of time that is sufficient to cause the driver 120 to quickly move to an operational state, thereby illuminating the light source 125. After the predetermined period expires, the boosting system 115 electrically supplies to the driver 120 the reduced-magnitude current. By way of example only, the predetermined period of time is approximately one half of one second. As one of skill in the art would understand, however, the duration of the output of the boosted current can be modified to suit the precise configuration of the driver 120 and light source 125 used in the system, as well as the desired light output. As one of skill in the art would further understand—assuming by way of example that that the boosted current is greater in magnitude than the reduced-magnitude current—the application of the boosted current may result in a brief "flash," or period of time in which the light source 125 receives more current than would normally be delivered by the dimmer 110 at that setting, which therefore illuminates the light source at a brighter level until the end of the predetermined period. Accordingly, as one of skill in the art would understand, in this embodiment, one consideration in selecting the predetermined period of time is a balance between providing sufficient power to cause the driver 120 to become operational while also minimizing the duration of any momentary flash that may occur.

In an alternative exemplary embodiment, the boosting system 115 senses both the activation of the dimmer 110 and the level at which the dimmer 110 is set. By way of example, there are dimmer 110 levels at which the reduced-magnitude current is sufficiently high to cause the light source 125 to illuminate immediately. This exemplary boosting system 115 determines the minimum dimmer setting required for immediate illumination. By way of example, the boosting system 115 is programmed with a minimum dimmer 100 setting. When the dimmer 110 is activated, the dimmer setting is compared to the minimum dimmer 100 setting, and if the result of the comparison is that the dimmer 110 is set at or above that minimum level, the boosting system 115 electrically supplies the reduced-magnitude current, rather than the boosted current, to the driver 120.

In another alternative exemplary embodiment, the boosting system 115 provides a pulsed boosted current, wherein the boosting systems 115 electrically supplies bursts of the boosted current interspersed with bursts of the reduced-magnitude current to the driver 120. By way of example only, the bursts of boosted current are sufficiently brief such that any flash caused by a burst is too brief for the human eye to detect it.

In one exemplary embodiment, the boosting system 115 has a microprocessor, microcontroller, or other similar control system that provides the boosting current and reduced-magnitude current to the driver 120 as set forth in the above-described exemplary embodiments of the present invention. The microprocessor, microcontroller, or other similar control system also senses when the dimmer has been initially turned on and the length of time over which the boosting system 115 has provided the boosting current. The microprocessor, microcontroller, or other similar control system is optionally electrically coupled to the dimmer 110 and receives a signal from the dimmer indicative of the dimmer setting. Alternatively, the boosting system 115 includes discrete circuit components that provide the same functionality.

In yet another alternative exemplary embodiment, the boosting system 115 monitors conditions in the system to determine when the boosted current (or the pulsed boosted current) has been provided to the driver 120 for a sufficient period of time, such that it becomes appropriate to provide the reduced-magnitude current to the driver 120. By way of example, when the driver 120 is in a state wherein it is charging to come up to operational status, but has not yet begun to power the light source 125, the current draw by the driver 120 will exhibit a detectable signature that differs from the signature exhibited by the driver 120 when it has reached a steady state and the light source 125 turns on. In one exemplary embodiment, the boosting system 115 monitors the current entering the driver 120, and when the boosting system 115 detects the change in signature, the boosting system 115 switches from supplying the boosted current (or pulsed boosted current) to supplying the reduced-magnitude current to the driver 120.

As described above, the system 100 also includes a driver 120 electrically coupled to the boosting system 115 and the light source 125. The exemplary driver 120 converts the current received from the boosting system 115 into a signal that is appropriate for the type of light source 125 that is connected to the system 100. By way of example, drivers 120 for LED or OLED light sources 125 convert either the boosted current or the reduced-magnitude current into direct current of the proper magnitude for the LEDs or OLEDs. Drivers 120 electrically connected to compact fluorescent light sources (which, in that case, are referred to as ballasts) convert either the boosted current or the reduced-magnitude current into high frequency alternating current that is appropriate for fluorescent operation. In either case, the drivers 120 themselves require energy to perform their assigned function.

Figure 2:
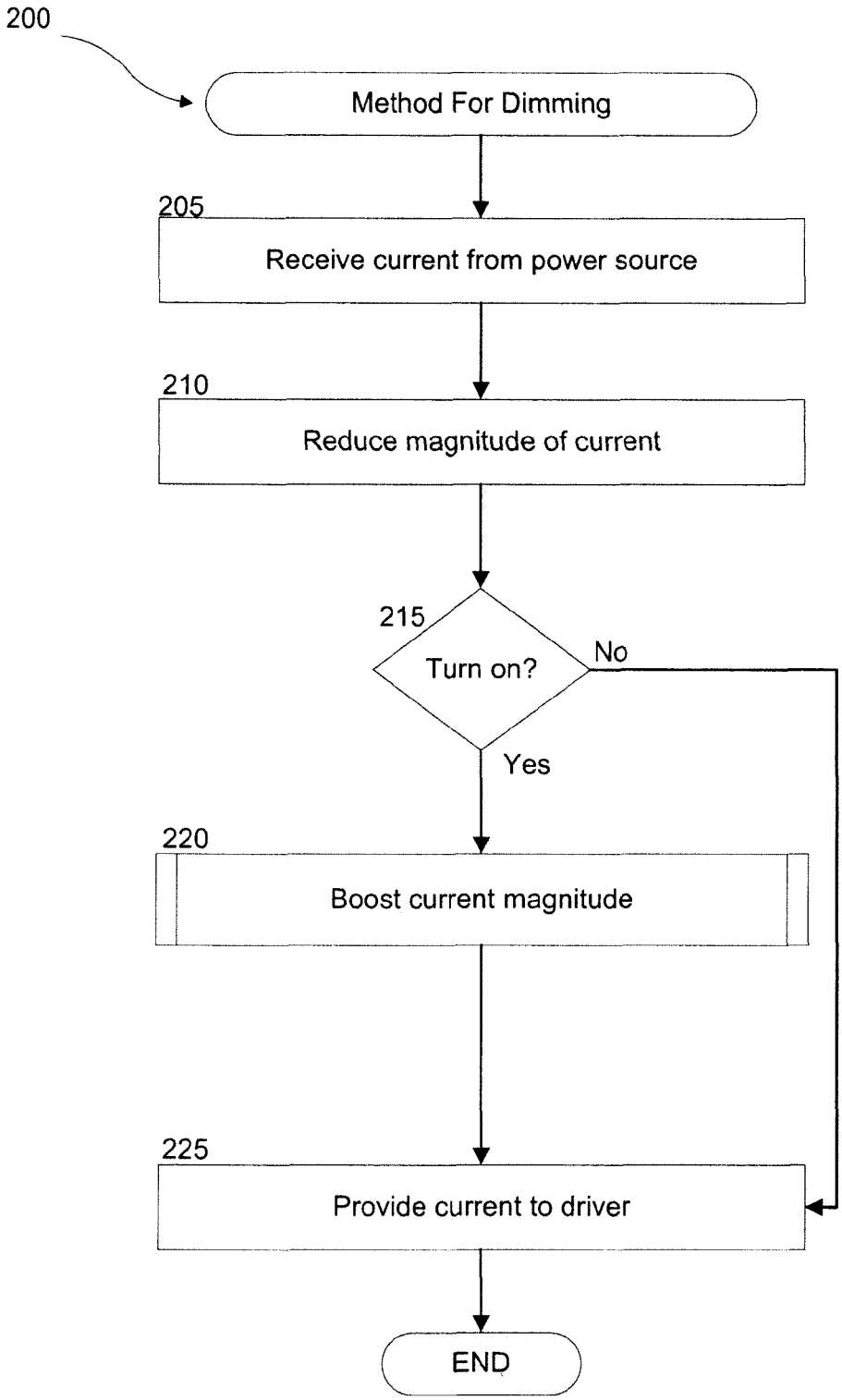
FIG. 2 is a flow chart describing an exemplary method for dimming a light source according to one exemplary embodiment.

FIG. 2 is a flow chart describing an exemplary method 200 for dimming according to an exemplary embodiment. FIG. 2 will be discussed with reference to FIG. 1. In step 205, the dimmer 110 receives current from the power source 105. In step 210, the magnitude of the power is reduced using the dimmer 110. In step 215, the boosting system 115 performs an inquiry to determine if it is receiving power for the first time after being turned off. In one exemplary embodiment, this determination is made by a controller in the boosting system 115. If the answer to the inquiry in step 215 is affirmative, the "Yes" branch is followed to step 220, wherein the boosting system 115 boosts the current as described above. The method 220 will be discussed in greater detail with respect to FIG. 3. Once the current has been boosted by the boosting system 115, the process proceeds to step 225, wherein the output of the boosting system 115 is electrically supplied to the driver 120, which then illuminates the light source 125. The method 200 concludes at the END step. Returning to the inquiry in step 215, if it is determined that the system has not just been turned on, then the "No" branch is followed to step 225, wherein the reduced-magnitude current received by the boost system 115 in step 210 is electrically supplied to the driver 120.

Figure 3:
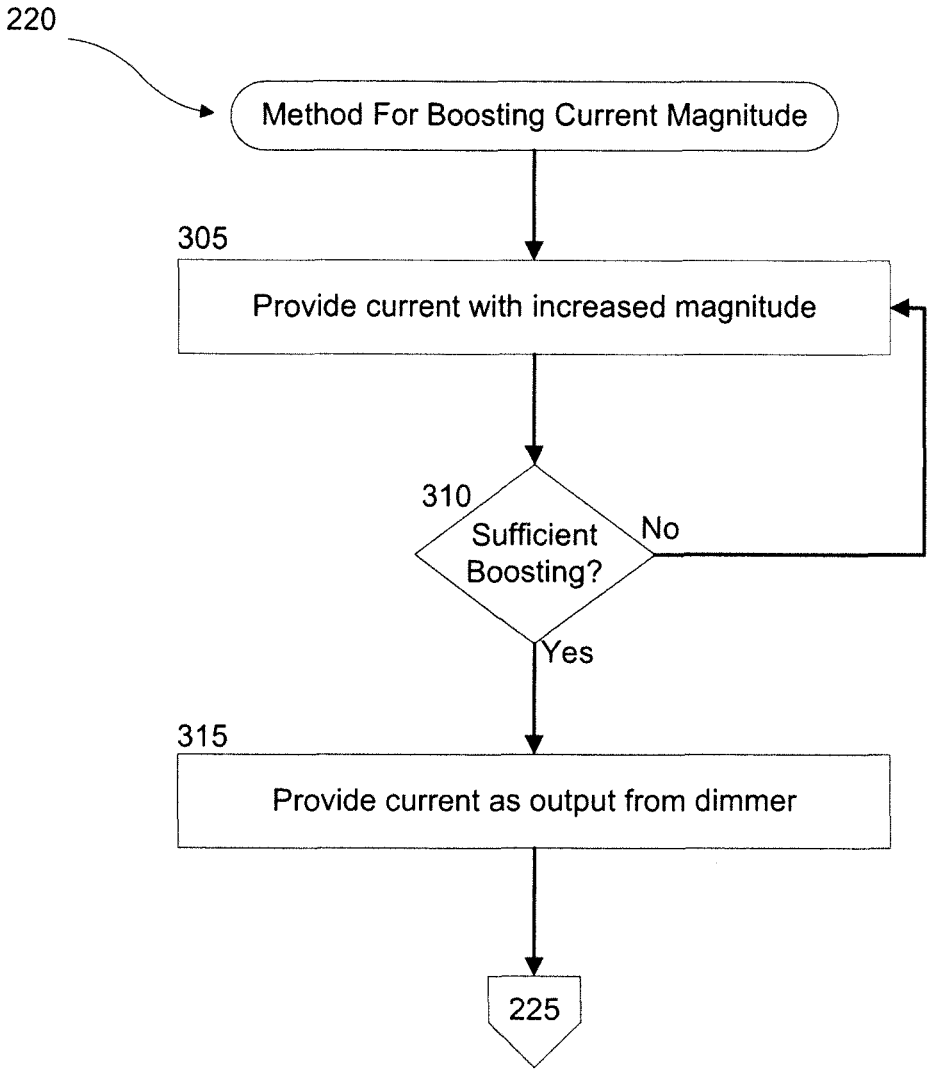
FIG. 3 is a flow chart describing an exemplary method for boosting current magnitude according to one exemplary embodiment.

FIG. 3 is a flow chart diagram describing an exemplary method 220 for boosting current magnitude. Referring now to FIGS. 1-3, the boosting system 115 provides current with an increased magnitude to the driver 120 in step 305. As discussed above, in one exemplary embodiment, the boosting system 115 electrically supplies the driver 120 with the current received from the power source 105, or some proportion thereof. Alternatively, the boosting system 115 electrically supplies the driver 120 a pulsed current that alternates between the reduced-magnitude current and the full current.

In step 310, an inquiry is conducted to determine if sufficient boosting has been provided by the boosting system 115. In one exemplary embodiment, the determination is made once the boosting system 115 has provided the boosted current for a predetermined period of time. Alternatively, the boosting system 115 makes the determination based on whether the signature of the driver's 120 current draw indicates that the driver 120 has finished powering up and is illuminating the light source 125. If the answer to the inquiry is affirmative, the method follows the "Yes" branch and proceeds to step 315, wherein the output of the dimmer 110 is electrically supplied to the driver 120. The method then returns to step 225 of FIG. 2. Turning again to step 310, if it is determined that sufficient boosting has not been provided by the boosting system 115, the "No" branch is followed back to step 305 and the boosting system 115 continues to electrically supply boosted current to the driver 120.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the invention. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A dimmer system for a luminaire, comprising:

a light source;

a dimmer configured to receive a first current and provide a reduced-magnitude current; and a boosting system electrically coupled to the dimmer, wherein the boosting system receives the reduced-magnitude current and determines whether the reduced-magnitude current is being received as part of a turn-on of the dimmer and wherein upon determining that the reduced-magnitude current is being received as part of the turn-on of the dimmer, provides a boosted current to the light source for a predetermined period of time and reverts back to the reduced-magnitude current after the predetermined period of time, wherein the boosted current comprises a pulse form, the pulse form comprising pulses of a boosted magnitude current interspersed with pulses of the reduced-magnitude current.

2. The dimmer system of claim 1, wherein the predetermined period of time is about 0.5 seconds.

3. The dimmer system of claim 1, wherein the magnitude of the boosted current comprises the magnitude of the first current.

4. The dimmer system of claim 1, wherein the light source comprises at least one light emitting diode.

5. The dimmer system of claim 1, wherein the magnitude of the boosted current is between about 70% and 100% of the first current.

6. A method for dimming a light source, comprising:

receiving a first current;

reducing the magnitude of the first current;

receiving the reduced magnitude current in a boosting system;

determining whether the reduced-magnitude current is being received as part of a turn-on of a dimmer;

providing a boosted current to a light source, in response to determining that the reduced magnitude current is being received as part of a turn-on of a dimmer, wherein the boosted current comprises a pulse form, the pulse form comprising pulses of a boosted magnitude current interspersed with pulses of the reduced-magnitude current; and providing the reduced-magnitude current to the light source after providing the boosted current.

7. The method of claim 6, wherein the boosted current is provided for a predetermined period.

8. The method of claim 6, wherein the magnitude of the boosted current comprises the magnitude of the first current.

9. The method of claim 6, wherein the light source comprises at least one light emitting diode.

10. A method for providing light, comprising:

receiving a first current from a power source;

reducing the magnitude of the first current based on the setting of a dimmer;

supplying the reduced-magnitude current to a boosting system;

determining whether the reduced-magnitude current is being received in connection with the turn-on of the dimmer; and in response to determining that the reduced-magnitude current is being received in connection with the turn-on of the dimmer, supplying a boosted current to a light source, wherein the boosted current comprises a pulse form, the pulse form comprising pulses of a boosted magnitude current interspersed with pulses of the reduced-magnitude current.

11. The method of claim 10, wherein supplying sufficient boosted current comprises providing boosted current for a predetermined period of time.

12. The method of claim 11, wherein the predetermined period of time is about 0.5 seconds.

13. The method of claim 10, wherein providing sufficient boosted current comprises the steps of:

monitoring a current drawn by the light source;

determining whether the current drawn by the light source comprises a signature indicative of the light source being illuminated; and providing boosted current until the current drawn by the light source comprises a signature indicative of the light source being illuminated.

14. The method of claim 13, wherein the light source comprises a driver.

15. The method of claim 10, wherein the light source comprises at least one light emitting diode.

* * * * *